US005092042A

United States Patent [19]

Miller et al.

[11] Patent Number: 5,092,042

[45] Date of Patent: Mar. 3, 1992

[54] SHAVING SYSTEM

[75] Inventors: Gary R. Miller, Tewksbury; Chester F. Jacobson, Southboro, both of Mass.

[73] Assignee: The Gillette Company, Boston, Mass.

[21] Appl. No.: 589,765

[22] Filed: Sep. 28, 1990

[51] Int. Cl.[5] ..... B26B 21/14; B26B 19/40; B26B 21/00; B26B 21/22

[52] U.S. Cl. ..... 30/77; 30/41; 30/49; 30/81; 30/34.2

[58] Field of Search ..... 30/77, 79, 81, 82, 83, 30/34.2, 41, 49

[56] References Cited

U.S. PATENT DOCUMENTS

| | | | |
|---|---|---|---|
| D. 290,050 | 5/1987 | Jacobson . | |
| 3,500,539 | 3/1970 | Muros . | |
| 3,722,090 | 3/1973 | Dawidowicz | 30/81 |
| 3,768,161 | 10/1973 | Miller . | |
| 3,786,563 | 1/1974 | Dorion, Jr. et al. | 30/83 |
| 4,378,634 | 4/1983 | Jacobson | 30/77 |
| 4,403,412 | 9/1983 | Trotta | 30/83 |
| 4,443,929 | 4/1984 | Motta et al. | 30/81 |
| 4,498,235 | 2/1985 | Jacobson . | |
| 4,516,320 | 5/1985 | Peleckis | 30/49 |
| 4,586,255 | 5/1986 | Jacobson . | |
| 4,587,729 | 5/1986 | Jacobson | 30/41 |
| 4,621,424 | 11/1986 | Jacobson . | |
| 4,914,817 | 4/1990 | Galligan . | |

*Primary Examiner*—Douglas D. Watts
*Assistant Examiner*—Paul M. Heyrana, Sr.
*Attorney, Agent, or Firm*—Fish & Richardson

[57] ABSTRACT

A shaving system includes body structure with guide structure and blade structure carried by the body structure. The blade structure has a cutting edge extending along the length of the body structure. A movable guard member of sheet material is carried by the body structure forwardly of the cutting edge of the blade structure and has a vertically extending rear wall portion, a sloped surface portion that extends forwardly in cantilever relation from the rear wall portion and that includes skin-tensioning surface structure, and integral guide portions disposed in the guide structure. The movable guard member is biased for dynamic movement as guided by the guide structure in the course of a shaving stroke.

16 Claims, 2 Drawing Sheets

SHAVING SYSTEM

This invention relates to shaving systems, and more particularly to shaving systems of the wet shave type.

A shaving system of the wet shave type includes at least one blade structure and a surface for engaging the user's skin adjacent the blade edge or edges. Typically, the shaving system includes a leading skin-engaging surface (forward of the cutting edge of the blade structure) and a trailing skin-engaging surface (rearwardly of the blade unit structure). The leading skin-engaging surface may be referred to as a guard surface and the trailing skin-engaging surface may be referred to as a cap surface. The skin-engaging surface(s) cooperates with the blade edge or edges and has one or more functions such as definition of shaving geometry, tensioning of skin in the region to be shaved, and/or delivery of shaving aid material to the skin surface during the shaving stroke. The shaving system may be of the disposable cartridge type adapted for coupling to and uncoupling from a razor handle or may be integral with a handle so that the complete razor is discarded as a unit when the blade or blades become dulled.

In accordance with one aspect of the invention, there is provided a shaving system that includes body structure that incorporates guide structure and blade structure carried by the body structure, the blade structure having a cutting edge extending along the length of the body structure. A movable guard member of sheet material is carried by the body structure forwardly of the cutting edge of the blade structure and has a vertically extending rear wall portion, a sloped surface portion that extends forwardly in cantilever relation from the rear wall portion and that includes skin-tensioning surface structure, and integral guide portions disposed in the guide structure. The movable guard member is positioned in engagement with biasing structure for dynamic movement of the movable guard member against the biasing structure as guided by the guide structure in the course of a shaving stroke.

In preferred embodiments, the integral guide portions are tab portions of a sheet metal member that are aligned with its rear wall portion, and the guide structure in the body structure includes opposed slots in which the tab portions are disposed for guiding movement of the metal guard member along a predetermined path, which is a straight-line path in particular embodiments. The skin-tensioning surface structure includes a plurality of ridges that extend generally parallel to the cutting edge, and each ridge has a crest with a radius of curvature less that 0.1 millimeter.

In particular embodiments, the shaving system has two blade structures that are mounted in spaced parallel relation for independent resilient movement with respect to the body structure; shaving aid material is carried by the support structure on the other side of the blade structures from the movable guard member; the tab portions of the guard member and the opposed body slots define a planar sliding axis; the sloped surface portion extends at an angle between 45° and 75° to the sliding axis; and the guard member has a depending skirt portion in front of the sloped surface portion that is generally parallel to the sliding axis. In a particular embodiment, the sloped surface portion has a plurality of apertures that extend along the transverse length of the sloped surface portion and rear surface portions of the apertures provide supplemental skin-tensioning surfaces.

Other features and advantages will be seen as the following description of particular embodiments progresses in conjunction with the drawings in which.

DESCRIPTION OF PARTICULAR EMBODIMENTS

Figure 1:
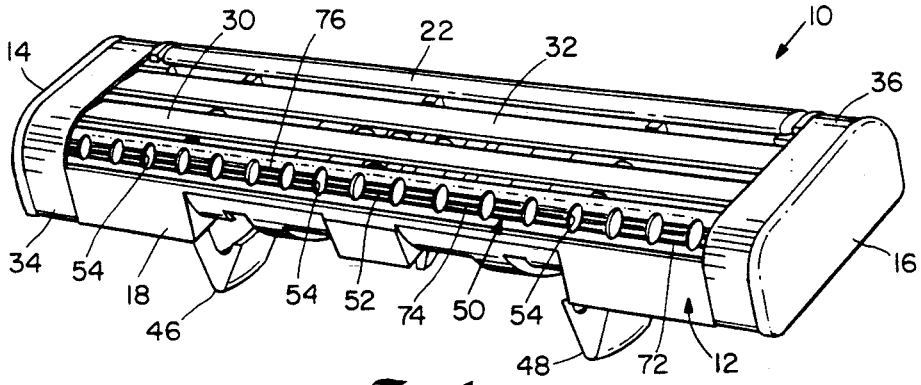
FIG. 1 is a perspective view of a shaving system in accordance with the invention.
Figure 2:
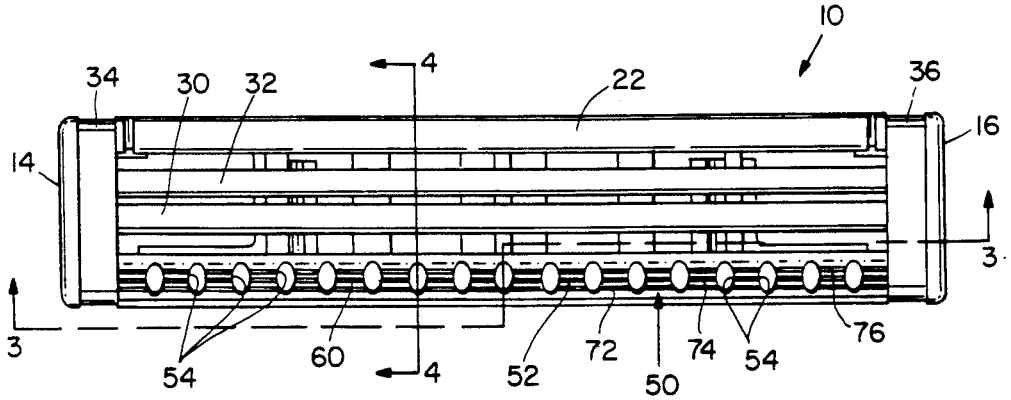
FIG. 2 is a plan view, with parts broken away, of the shaving system of FIG. 1.
Figure 3:
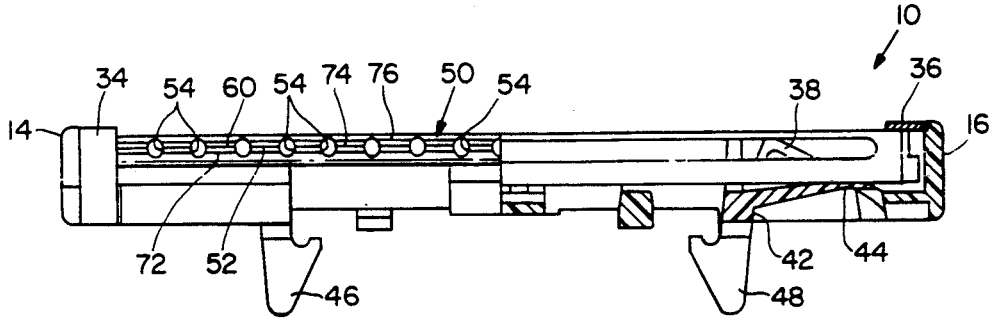
FIG. 3 is an elevational view taken along the line 3—3 of FIG. 2.

The razor blade assembly 10 shown in FIGS. 1–4 is of the type shown in Jacobson U.S. Pat. Nos. 4,498,235 and 4,586,255 (the disclosures of which are expressly incorporated herein by reference) and includes body member 12 of molded polymeric material that has end portions 14, 16 interconnecting front and rear portions 18, 20 and intermediate frame portions. Insert member 22 of shaving aid material, carried by rear portion 20, is made of a mixture of water insoluble polymeric matrix material (polystyrene) and water-leachable shaving aid material (polyethylene oxide).

Each end portion 14, 16 has opposed slots 24, 26, 28. Slots 24 receive slide portions of leading blade unit 30 and slots 26 receive slide portions of trailing blade unit 32. Each blade unit 30, 32 is biased upwardly against metal retaining bands 34, 36 by spring fingers 38, 40 respectively. Body member 12 also includes frame portions 42 that are provided with biasing spring fingers 44. Assembly 10 also includes depending extensions 46, 48, each of which includes an arcuate guide rail surface that engages in pivotal attachment to a razor handle (not shown).

Disposed in the region between front body wall portion 18 and leading blade unit 32 is metal guard member 50 that includes sloped skin-engaging portion 52 with spaced oval-shaped apertures 54 and depending skirt portion 56 that is received in recess 58 in front body wall portion 18. Webs 60 between apertures 54 have skin-tensioning transversely extending ridge portions 62. Vertical rear wall portion 64 has guide portions 66 at either end that are received in guide slots 28 of end portions 14, 16. Movable guard structure 50 is of 0.2 millimeter thick stainless steel and has a length of about three centimeters and is formed in a progressive die to provide rear wall portion 64 that has a height of about 2.6 millimeters, sloped skin-engaging surface portion 52 that has a projected horizontal dimension of about two millimeters and is inclined at an angle of about 60° to rear wall 64. Three 90 degree indents 72, 74, 76 that are 0.1 millimeter deep and spaced from each other with a projected horizontal dimension of about 0.4 millimeter form skin-tensioning ridge portions 62. Depending skirt portion 56 has a bottom edge 78 about 0.8 millimeter below surface portion 52. Apertures 54 are about 1.2 millimeters wide, and are spaced from each other about two millimeters on centers.

Figure 4:
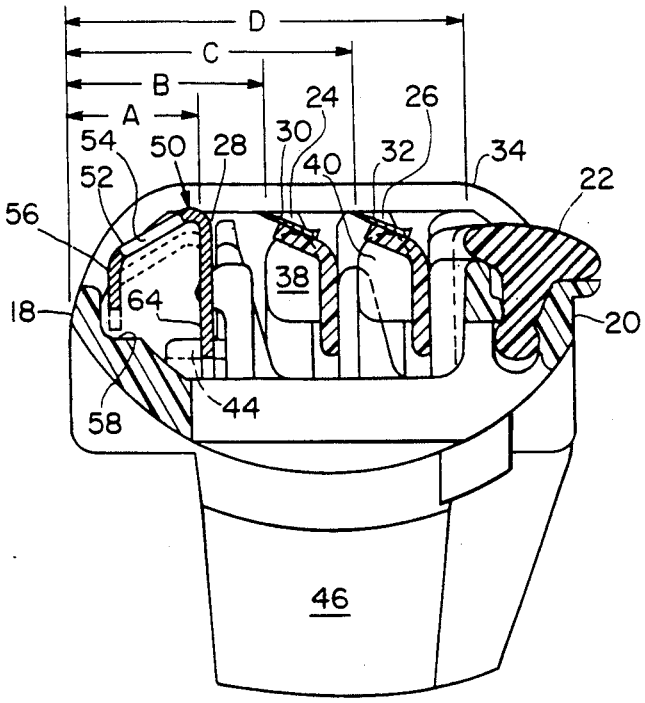
FIG. 4 is a sectional view of the shaving system of FIG. 1 taken along the line 4—4 of FIG. 2.
Figure 5:
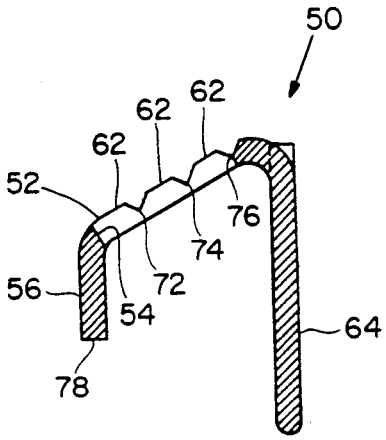
FIG. 5 is a side elevational view of guard structure incorporated in the shaving system of FIG. 1.
Figure 6:
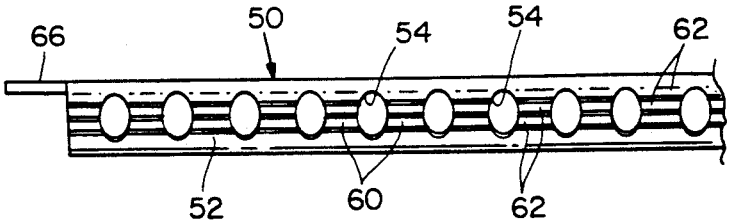
FIG. 6 is a top plan view of the guard structure of FIG. 5.

In assembly, the guide portions 66 of guard member 50 are positioned in slots 28 of body member 10, and biased upwardly against retaining bands 34, 36 by biasing fingers 44. Blade units 30 and 32 are similarly received in slots 24, 26 in end portions 14, 16 as indicated in FIGS. 1–4. As indicated in FIG. 4, the top of movable guard member 50 is positioned about two millimeters rearwardly of the front surface of body member 12 (dimension A), the cutting edge of blade structure 30 is positioned about three millimeters rearwardly of the front surface (dimension B); the cutting edge of blade structure 32 is positioned about four millimeters rearwardly of the front surface (dimension C); and the leading edge of shaving aid member 22 is positioned about six millimeters rearwardly of the front surface (dimension D).

The resulting blade assembly is attached to a handle for shaving and the guard member 50 and blade units 28 and 30 move independently of each other against the bias of the spring fingers during shaving. Concurrently, the blade assembly as a whole pivots on the handle, following the contours of the skin surface being shaved. Friction enhancing ridge surfaces 62 and the upper surfaces of apertures 54 tension the skin during the shaving stroke, and shaving aid material is concurrently transferred from member 22 for deposit on the skin surface being shaved.

Figure 7:
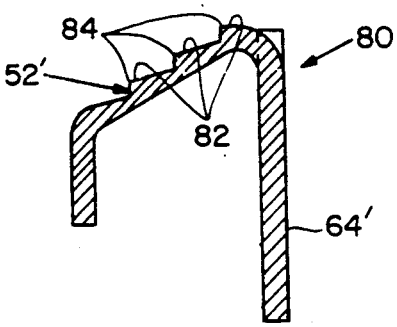
FIG. 7 is a sectional view of an alternative guard structure in accordance with the invention.

Another movable guard member embodiment is shown in FIG. 7. In that embodiment, movable guard member 80 is substituted for movable guard member 50 of the embodiment shown in FIGS. 1–4. Guard member 80 is similar to guard member 50 and sloped surface portion 52' has a length of about two millimeters and is inclined at an angle of about 60° to rear wall portion 64', but does not have apertures, and ridge portions 82 extend continuously the transverse length of surface 52' with crests 84 of about 0.04 millimeter radius that are spaced about 0.4 millimeter apart with intervening valleys of about 0.1 millimeter depth.

While particular embodiments of the invention have been shown and described, various modifications will be apparent to those skilled in the art, and therefore it is not intended that the invention be limited to the disclosed embodiments or to details thereof, and departures may be made therefrom within the spirit and scope of the claims.

What is claimed is:

1. A shaving system comprising body structure that incorporates guide structure, blade structure carried by said body structure, said blade structure having a cutting edge extending along the length of said body structure, a movable guard member carried by said body structure forwardly of said cutting edge of said blade structure, said guard member being of sheet material and having a vertically extending rear wall portion, a sloped surface portion extending forwardly in cantilever relation from said rear wall portion, said sloped surface portion including skin-tensioning surface structure, said guard member having integral guide portions disposed in said guide structure, said movable guard member being positioned in engagement with biasing structure for dynamic movement of said movable guard member against said biasing structure as guided by said guide structure in the course of a shaving stroke.

2. The shaving system of claim 1 wherein said integral guide portions are tab portions of said sheet member that are aligned with said rear wall portion, and said guide structure in said body structure includes opposed slots in which said tab portions are disposed for guiding movement of said metal guard member along a predetermined path.

3. The shaving system of claim 2 wherein said tab portion and said opposed slots define a planar sliding axis and said sloped surface portion extends at an angle between 45° and 75° to said sliding axis.

4. The shaving system of claim 3 wherein said guard member has a depending skirt portion that is in front of said sloped surface portion and is generally parallel to said sliding axis.

5. The shaving system of claim 1 wherein said skin-tensioning surface structure includes a plurality of ridges that extend generally parallel to said cutting edge.

6. The shaving system of claim 5 wherein each said ridge has a crest with a radius of curvature less than 0.1 millimeter.

7. The shaving system of claim 1 wherein said sloped surface portion has a plurality of through apertures therein adjacent said skin-tensioning surface structure.

8. The shaving system of claim 1 wherein said blade structure is mounted for resilient movement with respect to said body structure.

9. The shaving system of claim 8 and further including second blade structure mounted on said body structure for resilient movement with respect to said body structure.

10. The shaving system of claim 9 and further including shaving aid material carried by said support structure on the other side of said blade structures from said movable guard member.

11. The shaving system of claim 10 wherein said movable guard member is positioned about two millimeters rearwardly of the front surface of said body structure, the cutting edge of said first blade structure is positioned about three millimeters rearwardly of said front surface; the cutting edge of said second blade structure is positioned about four millimeters rearwardly of said front surface; and the leading edge of said shaving aid member is positioned about six millimeters rearwardly of said front surface.

12. The shaving system of claim 11 wherein said biasing structure comprises resilient fingers integral with said body structure.

13. The shaving system of claim 12 wherein said sloped surface portion extends at an angle between 45° and 75° forwardly in cantilever relation from said rear wall portion.

14. The shaving system of claim 13 wherein said sloped surface portion has a plurality of through apertures therein adjacent said skin-tensioning surface structure.

15. The shaving system of claim 14 wherein said guard member has a depending skirt portion that is in front of said sloped surface portion and is generally parallel to said rear wall portion.

16. The shaving system of claim 15 wherein said skin-tensioning surface structure includes a plurality of ridges that extend generally parallel to said cutting edge, each said ridge having a crest with a radius of curvature less than 0.1 millimeter.

* * * * *